US005189726A

United States Patent [19]

Pan

[11] Patent Number: 5,189,726

[45] Date of Patent: Feb. 23, 1993

[54] STEAM PRODUCING APPARATUS FOR HOME USE WITH LOW COLD WATER RESERVOIR LEVEL STEAM OUTPUT STOPPAGE

[75] Inventor: Costanzo Pan, Borgosatollo, Italy

[73] Assignee: CTS Costruzioni Techniche Sanmarinesi, Italy

[21] Appl. No.: 662,746

[22] Filed: Mar. 1, 1991

[30] Foreign Application Priority Data

Sep. 28, 1990 [IT] Italy ..... 21884/90[U]

[51] Int. Cl.[5] ..... H05B 1/02; D06F 75/10; F24H 1/28; H01H 36/02

[52] U.S. Cl. ..... 392/401; 38/77.6; 200/84 C; 392/405

[58] Field of Search ..... 392/400–406, 392/324–337; 38/77.6; 200/84 C

[56] References Cited

U.S. PATENT DOCUMENTS 2,302,528 11/1942 Conklin ..... 392/402 X
2,623,153 12/1952 McGinnis ..... 392/401
3,508,354 4/1970 Stansbury et al. ..... 38/77.6
4,748,300 5/1988 Anderson ..... 200/84 C
4,841,107 6/1989 Tandler ..... 200/84 C

FOREIGN PATENT DOCUMENTS 69858 1/1983 European Pat. Off. ..... 392/402
1284171 8/1972 United Kingdom ..... 392/402

*Primary Examiner*—Anthony Bartis
*Attorney, Agent, or Firm*—Laff, Whitesel, Conte & Saret

[57] ABSTRACT

The apparatus comprises a boiler (2) provided with an electric resistance heating element (3) arranged to heat and vaporize water, a water reservoir (6) independent of the boiler and a pump (8) designed to transfer water from the reservoir to the boiler. In the boiler a predetermined amount of water substantially corresponding to 50% of the overall capacity of the boiler itself is kept constant, thereby maintaining the steam amount unaltered and making the steam use always immediate. A steam control valve connected to the boiler (2) is driven by a magnetic float switch (14) housed in the water reservoir (6) to stop the steam emission when the cold water reservoir (6) is empty.

7 Claims, 1 Drawing Sheet

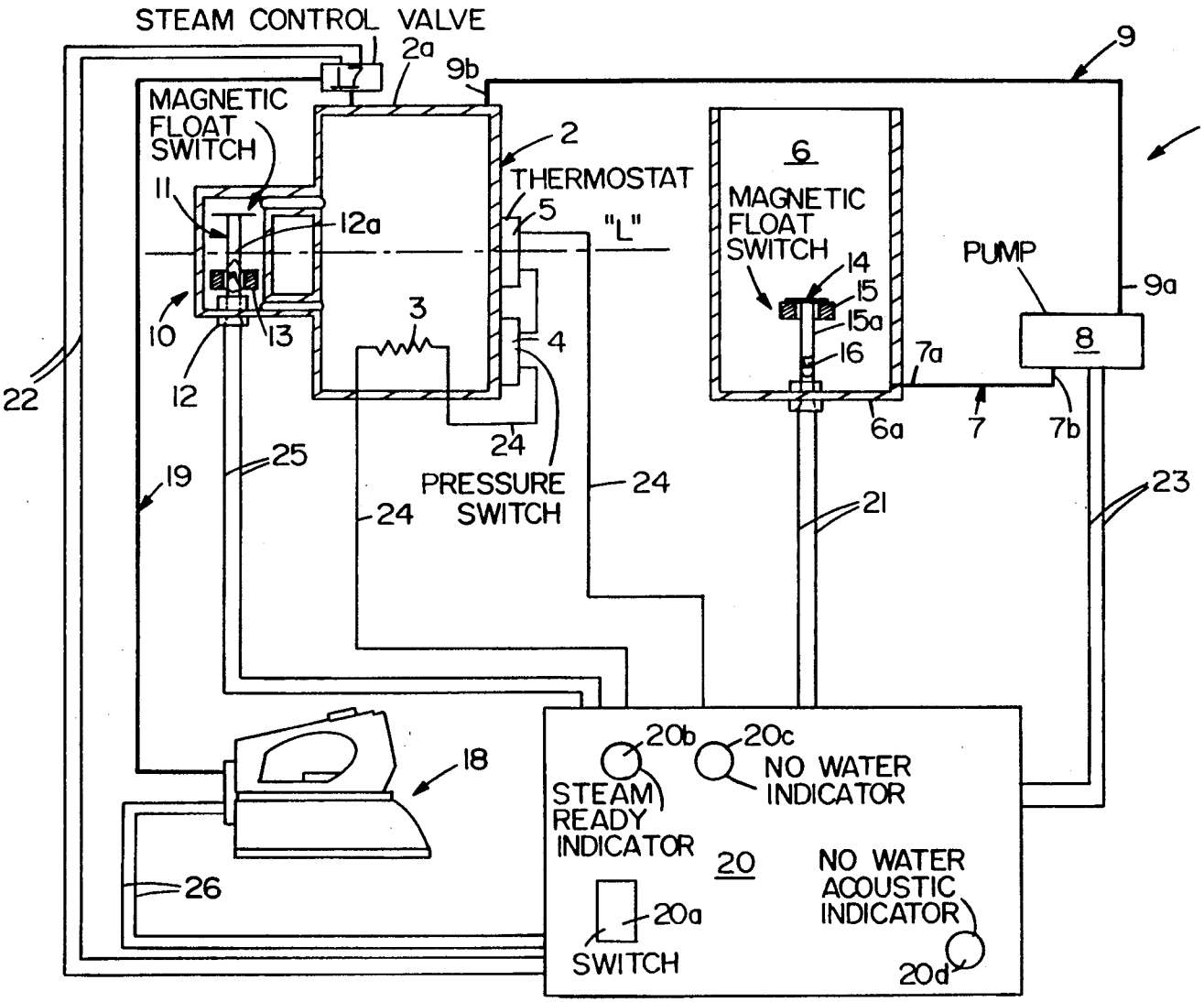
STEAM CONTROL VALVE
MAGNETIC FLOAT SWITCH
THERMOSTAT
"L"
PRESSURE SWITCH
PUMP
MAGNETIC FLOAT SWITCH
NO WATER INDICATOR
NO WATER ACOUSTIC INDICATOR
STEAM READY INDICATOR
SWITCH
1
2
2a
3
4
5
6
6a
7
7a
7b
8
9
9a
9b
10
11
12
12a
13
14
15
15a
16
18
19
20
20a
20b
20c
20d
21
22
23
24
25
26

STEAM PRODUCING APPARATUS FOR HOME USE WITH LOW COLD WATER RESERVOIR LEVEL STEAM OUTPUT STOPPAGE

FIELD AND BACKGROUND OF THE INVENTION

The present invention relates to a steam producing apparatus for home use, fed by a cold water reservoir.

Presently these apparatuses are used in steam household appliances, such as steam irons or apparatus to clean carpets, moquette and the like.

It is known that these steam producing apparatus are equipped with a boiler provided with a resistor designed to heat and vaporize water. This boiler has a steam outlet duct and a water admitting element which can be a filler or a duct connected to a reservoir.

The use of boilers directly admitting water through the filler on the part of a user, is somewhat dangerous when the water topping up is to be carried out, and also has other drawbacks.

In fact, in order to eliminate the risk of dangerous steam jets when cold water is added into the boiler, a separate cold water reservoir connected to the boiler by a pump has been used.

This arrangement has been depicted in the Italian patent application for utility model No. 21475B/83.

The described apparatus comprises a boiler provided with an electric resistance heating element to heat and vaporize water, a water cold reservoir independent of the boiler and a pump in fluid communication with the boiler on one hand, and the reservoir on the other hand. The pump enabling the water to enter the boiler from the reservoir is activated by a detector detecting the minimum water level in the boiler and deactivated by another maximum water level detector.

It has been found that the use of a cold water reservoir connected to the boiler through a duct eliminates some problems but leaves other problems unsolved.

In fact, while the apparatus of the above described type have proved to have a good efficiency in operation, some drawbacks have however been found due to the prolonged use of the apparatus.

One problem resides in the fact that the topping-ups in the reservoir are effected on the discretion of the user who must periodically check the water level. As a result, so long as there is water in the reservoir the pump carries out the subsequent boiler fillings upon command of minimum and maximum water level detectors and the apparatus works properly.

However, as soon as the reservoir is empty, the steam delivery is no longer homogeneous because the water used is that remaining in the boiler until it is completely exhausted.

Then another problem originates from the fact that when the water in the reservoir and the boiler has been depleted, the heating element becomes overheated since it is no longer cooled by the water. This fact brings about an alteration in the good operation of the apparatus unless the use of thermostats is provided which on the other hand cannot ensure an immediate intervention.

A further problem arises each time water is admitted to the boiler from the reservoir. In fact if given equilibrium conditions are not maintained between the water and steam amounts and consequently between temperature and pressure, under this condition it will be necessary to wait before having steam delivered again, due to the fact that the temperature of the water in the reservoir is lower than that in the boiler.

SUMMARY OF THE INVENTION

The object of the present invention is to solve the problems of the known art by an apparatus of easy construction offering an improved operation.

A particular object of the invention is also to receive a signalling about the total water consumption in the reservoir while having the apparatus operation interrupted.

A further object of the invention is to provide an apparatus enabling a continuous steam delivery at constant pressure and temperature values, during the apparatus operation, without interruptions or waits.

Yet another object of the invention is to provide an apparatus capable of ensuring a safe operation and preventing damages to the apparatus itself.

In accordance with the present invention, the above identified drawbacks and problems are eliminated by inserting in the cold water reservoir a magnetic float switch which is capable to deactivate a steam control valve connected to the boiler, when the cold water reservoir is empty.

More particularly, the invention relates to a steam producing apparatus for home use with a cold water reservoir comprising a boiler provided with an electric resistance heating element designed to heat and vaporize water, a thermostat intervening on the heating element to keep a temperature control in the boiler, a water reservoir independent of the boiler, a pump arranged to transfer water from the reservoir to the boiler and the first magnetic float switch associated with the boiler and intervening on the pump to keep a predetermined amount of water constant in the boiler, said apparatus further comprising, a second magnetic float switch located in the reservoir, signaling the lack of water in the reservoir itself and connected to a solenoid shutoff valve associated with the steam outlet of the boiler for carrying out the interruption of steam delivery from the boiler in response to the sensing of a predetermined minimum water level in the reservoir by said second magnetic float switch.

BRIEF DESCRIPTION OF THE DRAWINGS

Further features and advantages will be best understood from the detailed description of a steam producing apparatus for home use, in accordance with the present invention, given hereinafter by way of nonlimiting example with reference to the accompanying drawings, in which the sale figure is a general diagrammatic view of the apparatus in accordance with the present invention connected to a steam iron.

DESCRIPTION OF THE PREFERRED EMBODIMENT

Referring to the drawing, a steam producing apparatus for home use in accordance with the invention has been generally identified by reference numeral 1.

The steam producing apparatus 1 comprises a steam producing boiler 2 provided with an electric resistance heating element 3 designed to heat and vaporize water. Boiler 2 is also equipped with a manostat 4 to keep the pressure control and at least a thermostat 5 to keep the temperature control.

The boiler 2 is connected to a reservoir 6 for cold water. Located at the bottom 6*a* of this reservoir 6 is one end 7*a* of a water outlet duct 7 which is connected, at the other end 7*b* thereof, to a pump 8 for the automatic charging of water into the boiler 2. At the pump outlet 8 there is one end 9*a* of a second duct 9 connected, at the other end 9*b* thereof, to the upper portion 2*a* of boiler 2.

Externally of the boiler 2 and connected thereto following the principe of communicating vessels is a basin 10 having, at the inside thereof, a first magnetic float switch 11 provided with a first microcontact 12 housed in a first stem-like tube 12*a* and a first magnetic float 13 movable along the first stem-like tube 12*a*. The first magnetic float 13 is designed to close the first microcontact 12 when the first magnetic float 13 is in a lower position and open it when the first magnetic float 13 is in an upper position relative to the average loading level corresponding to the water-steam separation line, identified by L in the figure.

Advantageously within the reservoir 6 there is a second magnetic float switch 14 for the cold water level control in the reservoir comprising a second magnetic float 15 guided along a second stem-like tube 15*a* and a second microcontact 16 housed in the second stem-like tube 15*a*.

In this case, when the second magnetic float 15 is in a high position, that is when there is the presence of water, the second microcontact 16 is open, whereas when the second magnetic float 15 is in a low position, that is when water lacks, the second microcontact 16 is closed.

Said second magnetic float switch 14, designed to signal the lack of water in the reservoir 6, is also connected to a solenoid shutoff valve 17, located at the top of the boiler 2, carrying out the interruption of steam delivery from the boiler 2 when a predetermined minimum water level is reached in the reservoir 6.

The second magnetic float switch 14 also carries out the stoppage of the pump 8 when said minimum water level is reached in the reservoir.

For the above reasons, the solenoid valve 17 is capable of ensuring steam having constant pressure and temperature characteristics to a steam iron 18 connected to the boiler 2.

In the embodiment shown the solenoid valve 17 is connected to the steam iron 18 by a third duct 19.

Apparatus 1 finally comprises an electric control board 20 of known type coordinating and connecting all the apparatus components.

In fact, when the second magnetic float switch 14 sends a signal to the control board 20, through a connection 21, said board 20 sends a signal to the solenoid valve 17, through a connection 22, and to the pump 8, through a connection 23.

In addition, the control board 20 is connected to boiler 2 through a connection 24, in series with the thermostat 5, manostat 4 and heating element 3 respectively.

Finally the control board 20 is connected to the first magnetic float switch 11, through a connection 25, and the steam iron through a connection 26.

OPERATION

Operation of the steam producing apparatus according to the invention described above mainly as regards structure, is as follows.

Water is poured into the reservoir 6 until the maximum reservoir capacity is reached. A switch 20*a* located on the electric control board 20 is brought to its "on" position. Automatically the pump 8 begins sending water to the boiler 2 taking it from the reservoir 6 until the water reaches the level controlled by the first magnetic float switch 11. The magnetic float switch 11 stops the pump 8 operation at the moment that the water reaches an established level identified by L in the drawing and corresponding to about 50% of the capacity of boiler 2, leaving the remaining 50% free.

At this point heating element 3 begins heating the water until steam is produced, signalling on the control board 20, by means of a tell-tale lamp 20*b*, that the steam iron 18 is ready for use.

As time goes by and steam is used, the water contained in the boiler tends to decrease and its level goes below the water-steam separation line L.

As a result, the first magnetic float switch 11 closes, through its first magnetic float 13, the first microcontact 12 causing the operation of the pump 8 which begins sending water to the boiler 2, thereby restoring the water level. The intervention of the pump 8 takes place each time the water level goes below the predetermined level corresponding to a slight level difference with respect to the starting level of the water in boiler 2.

By operating in this manner only small amounts of water are admitted each time so that the inner equilibrium conditions of the boiler are not altered and the steam iron 18 is always available for use.

In use the water contained in the reservoir 6 decreases in level and once it has reached its minimum level the second magnetic float switch 14 sends a signal to the control board 20.

The control board 20 stops the apparatus use by means of the solenoid valve 17, also informing the user, by a warning light 20*c* and/or an acoustic warning 20*d* located on the control board itself that water must be added into the reservoir 6 in order to restore the starting level.

This happens because the second magnetic float 15 of the magnetic float switch 14 closes the second microcontact 16 once it has reached its minimum level position. As a result of the closure of the second microcontact 16, a signal to the solenoid valve 17 and a signal to the pump are respectively sent from the control board 20, the first signal causing the stopping of steam issue from boiler 2 and the second blocking the operation of the pump itself.

After the reservoir 6 has been filled with water, the second float 15 reaches its maximum level position and opens the second microcontact 16 again, thereby immediately restoring the apparatus use.

Advantageously, if the second magnetic float switch 14, pump 8 or solenoid valve 14 should not work perfectly, the boiler 2 would be further adjusted by the thermostat 5 and manostat 4 intervening on the heating elements 3, through the control board 20.

The present invention attains the intended purposes.

In fact the present invention allows the water consumption in the reservoir to be signalled, the emission of steam from the boiler to be stopped when the water level in the reservoir is below the minimum level, and the heating element over heating to be avoided, which could alter the good working of the whole apparatus.

It is important to note that the availability of a boiler having constant amounts of water and steam also enables the steam temperature and pressure characteristics to be kept constant during the ironing.

It will be recognized that by keeping the water level constant in the boiler and not taking up the whole boiler capacity at each filling any excess of water is avoided, which water would be on the other hand ejected making the apparatus temporarily unusable.

It is also important to note that the boiler is filled automatically and continuously thereby maintaining the steam amount and characteristics constant in use, all that without down times, while waiting for the water to be heated both between one topping up of the boiler and the other and after the second filling of the reservoir.

Finally, the apparatus offers a safe operation and greatly increases the practicality, continuity and duration of use.

Obviously many modifications and variations can be made to the invention as conceived, all of them falling within the scope of the invention idea characterizing it.

What is claimed is:

1. A steam producing apparatus for home use, fed by a cold water reservoir, comprising a boiler provided with an electric resistance heating element designed to heat and vaporize water, a thermostat intervening on the heating element to keep a temperature control in the boiler, a water reservoir independent of the boiler, a pump arranged to transfer water from the reservoir to the boiler and a first magnetic float switch associated with the boiler and intervening on the pump to keep a predetermined amount of water constant in the boiler, said apparatus further comprising a second magnetic float switch located in the reservoir, signalling the lack of water in the reservoir itself and connected to a solenoid shutoff valve associated with the steam outlet of the boiler for carrying out the interruption of steam delivery from the boiler in response to the sensing of a predetermined minimum water level in the reservoir by said second magnetic float switch.

2. The apparatus as claimed in claim 1, wherein said second magnetic float switch carries out the stoppage of said pump in response to the sensing of the predetermined minimum water level in the reservoir by said second magnetic float switch.

3. The apparatus as claimed in claim 1, wherein said second magnetic float switch activates a warning light located on an electric control board and connected to the second magnetic float switch itself to signal said predetermined minimum water level.

4. The apparatus as claimed in claim 3, wherein said second magnetic float switch activates an acoustic warning located on said electric control board.

5. The apparatus as claimed in claim 1, wherein said solenoid shutoff valve adapted to control the steam delivery from the boiler and break the flowing thereof is disposed at the top of the boiler.

6. The apparatus as claimed in claim 1, wherein said first magnetic float switch and second magnetic float switch comprise a microcontact and a magnetic float adapted to close the microcontact when said magnetic float is in a predetermined position.

7. The apparatus as claimed in claim 1, wherein a predetermined amount of water substantially corresponding to 50% of the overall capacity of said boiler is kept constant in said boiler by said first magnetic float switch.

* * * * *